US006989844B2

(12) United States Patent
Kageyama et al.

(10) Patent No.: US 6,989,844 B2
(45) Date of Patent: Jan. 24, 2006

(54) IMAGE DISPLAY

(75) Inventors: Hiroshi Kageyama, Hachioji (JP); Toshio Miyazawa, Chiba (JP)

(73) Assignee: Hitachi, Ltd., Tokyo (JP)

( * ) Notice: Subject to any disclaimer, the term of this patent is extended or adjusted under 35 U.S.C. 154(b) by 222 days.

(21) Appl. No.: 10/366,424

(22) Filed: Feb. 14, 2003

(65) Prior Publication Data

US 2004/0036702 A1 Feb. 26, 2004

(30) Foreign Application Priority Data

Aug. 23, 2002 (JP) ..... 2002-243292

(51) Int. Cl.
*G09G 5/10* (2006.01)

(52) U.S. Cl. ..... 345/690; 345/87; 345/88; 345/89; 345/90; 345/209

(58) Field of Classification Search ..... 345/690, 345/87–90, 96, 100, 209
See application file for complete search history.

(56) References Cited

U.S. PATENT DOCUMENTS 4,769,792 A * 9/1988 Nogami et al. ..... 365/222
5,414,521 A * 5/1995 Ansley ..... 348/123
6,738,005 B2 * 5/2004 Koyama et al. ..... 341/144
6,778,163 B2 * 8/2004 Ozawa ..... 345/96

FOREIGN PATENT DOCUMENTS

JP 11-068476 * 3/1999

* cited by examiner

*Primary Examiner*—Vijay Shankar
*Assistant Examiner*—Leonid Shapiro
(74) *Attorney, Agent, or Firm*—Antonelli, Terry, Stout & Kraus, LLP

(57) ABSTRACT

There will be provided an image display, pixel TFTs and driving circuit of which are constituted by channel type TFTs of either n-channel or p-channel, capable of poly-gradation display. In an image display according to the present invention, there is provided switching means selecting means (shift register) for selectively inputting a driving signal inputted into the switch driving line into a plurality of switching means (switch matrix); the pixels (display electrodes), signal lines, switching means, decoding means (decoder) and the switching means selecting means are formed on the same substrate; and the transistors constituting the pixels, the switching means, the decoding means and the switching means selecting means are constituted by only channel type transistors of either n-channel or p-channel. The driving circuit can be integrally formed on the substrate together with the pixel transistors.

12 Claims, 15 Drawing Sheets

IMAGE DISPLAY

BACKGROUND OF THE INVENTION

1. Field of the Invention

The present invention relates to an image display.

2. Description of Related Art

In recent years, in the field of flat panel display, the liquid crystal display has commanded a substantial share. The liquid crystal display is an image display in which a liquid crystal is interposed between two sheets of substrates made of glass or the like, for controlling light and displaying an image by changing the light transmission factor or reflection factor. Even among liquid crystal displays, an active matrix type liquid crystal display using a thin film transistor (hereinafter, abbreviated as TFT) as an active pixel for each pixel is fast in response, and has a clear image, and therefore, is currently in vogue.

For the TFT, in addition to amorphous silicon TFT (a-Si TFT) liquid crystal display which has been widely used for the conventional active matrix liquid crystal display, there is a polysilicon TFT (Poly-Si TFT) having mobility of double or more digits higher than the a-Si TFT. When the mobility of the TFT is high, it is possible to cause a large current to flow by means of the TFT, and also a circuit using the TFT is capable of operating at higher speed.

Thereby, it has become possible to integrally form a driving circuit, which has been externally mounted to the outside portion of the substrate as a driver IC in a liquid crystal display using the a-Si TFT, with a pixel TFT at the peripheral portion of the substrate. Also, it has become possible to form a circuit for driving a pixel circuit for an active matrix type light emitting diode (LED) display for displaying an image by controlling the current through a luminous element. An example of a pixel circuit of the LED display is described in FIG. 1 on page 236 of the proceedings of the $7^{th}$ International Display Workshop (IDW'00).

FIG. 13 shows an example of structure of an active matrix type TFT liquid crystal display. FIG. 13 is also an example in which the driving circuit is constituted by the Poly-Si TFT, and is integrally formed with the pixel TFT at the peripheral portion of the substrate. Further, FIG. 13 shows an example of the liquid crystal display for inputting a digital image signal to display an image.

A transparent substrate 151 is one of the substrates for interposing the liquid crystal therebetween, and on a display area 156 on the upper surface of the substrate, signal lines 152 are wired in the vertical direction on the page space and scanning lines 153 are wired in the horizontal direction on the page space in the matrix shape. At the intersections between the signal lines 152 and the scanning lines 153, there are pixel TFT154 and display electrodes 155. In the upper direction of the page space of the transparent substrate 151, another sheet of transparent substrate which is not shown in the drawing is laid on top of the transparent substrate 151, and the liquid crystal is interposed therebetween to constitute the liquid crystal display. On this another sheet of transparent substrate, a transparent electrode called an opposite electrode is formed on the surface of the liquid crystal side. Between the display electrode 155 and the opposite electrode, AC voltage is applied, and the image is displayed by changing the light transmission factor and reflection factor by the effective value of the AC voltage.

Usually, to their respective signal lines 152, an analog voltage signal corresponding to a signal of an image to be displayed is supplied, in synchronization with which a pulse for switching the pixel TFT154 to a specified scanning line 153 is supplied, whereby analog voltage of the signal line 152 is supplied to the display electrodes 155 of a horizontal row. Even if the pixel TFT 154 becomes OFF, voltage supplied to the display electrode 155 is retained by means of capacity with the opposite electrode or capacity provided with other wiring. Thereafter, every time an analog signal is supplied to the signal line 152, the scanning line 153 for transmitting the pulse will be changed in turn. When supplying the pulse to all the scanning lines 153 is finished, predetermined voltage is to be supplied to each display electrode 155.

As a driving circuit for supplying such a signal line 152 as described above and a signal of the scanning line 153, at the peripheral portion of the transparent substrate 151, a scanning circuit 157 and a signal circuit 158, 159 are formed by TFT.

The scanning circuit 157 is constituted by a shift register, and has a function for generating a pulse to each output G1–G2 in turn.

The signal circuit 158, 159 is, as shown in FIG. 14, composed of: a shift register 171; a latch 172; and a DA conversion circuit 173, and has a function for distributing image data to be inputted from a data signal line DB to each output S1-S3, and a function for converting a digital signal to an analog signal.

As one of indices for performance of the image display, there is a bit number of display gradation. Assuming the bit number to be n, it is possible to change brightness of each pixel to $2^n$ levels, and an image display having a high bit number is capable of expressing an image having a smooth change in brightness and color more accurately. The bit number of display gradation of liquid crystal displays for use with latest note personal computers and the like is frequently 6-bit or higher. This bit number of display gradation is determined by a bit number of voltage gradation of a DA conversion circuit 173 of a signal circuit.

A digital image signal inputted from the data signal line DB is stored in each of latches 172 by a pulse to be outputted from the shift register 171 in order. The digital image signals stored in the respective latches are converted into analog voltage by the DA conversion circuit 173 to be outputted to S1 to S3. Also, the signal circuit 159 is also constituted by the same circuit as shown in FIG. 14.

In order to convert voltage to be applied to a liquid crystal to AC, symmetrical voltage groups VR+ and VR− are supplied to the DA conversion circuit within the signal circuit 158 and the signal circuit 159 of FIG. 13, and voltage generated by the signal circuit 158, 159 is supplied to odd-numbered and even-numbered signal lines 152 by changing over for each horizontal period or vertical period by means of a change-over switch 160 constituted by TFT.

A circuit in the peripheral portion of the signal circuit 158, 159, the scanning circuit 157 and the like is constituted by the Poly-Si TFT, whereby the circuit can be integrally formed with each element of the display area 156. Therefore, in the liquid crystal display constituted by the Poly-Si TFT, the cost can be cut down because there is no need for the driver IC for the signal circuit and the scanning circuit which have been externally mounted on to the substrate in the liquid crystal display constituted by the a-Si TFT.

An example in which the driving circuit for the liquid crystal display is constituted by the Poly-Si TFT and is integrally formed in the peripheral portion of the display area, is described in the Extended Abstracts of the 1997 International Conference on Solid State Devices and Materials pp. 348–349 FIG. 2.

In order to provide a liquid crystal display for integrally forming a driving circuit on a substrate through the use of a Poly-Si TFT, with a display gradation performance of 6-bit or more, it is necessary to incorporate a DA conversion circuit of 6-bit or more in the signal circuit 158, 159.

In the circuit area of the DA conversion circuit incorporated in the signal circuit 158, 159, when the bit number is increased, the circuit scale increases. FIG. 15 shows a circuit diagram of a 6-bit DA conversion circuit formed through the use of both an n-channel TFT 182 and a p-channel TFT 181. Taking advantage of the characteristic property that the n-channel TFT turns ON when the gate potential is high, and turns OFF when it is low, and that the p-channel TFT turns ON when the gate potential is low, and turns OFF when it is high, voltage of gradation voltage wiring V0 to V63 is to be selected at logic voltage of 6-bit in accordance with the tournament system. In this structure, when the bit number is n, a number of the data bus wiring Dbus needs n pieces, and when the n is increased, the number of the data bus wiring is increased. When n=6, the number is 6.

When the DA conversion circuit is formed on the transparent substrate 151, however, there are the following problems. For the metallic wiring layer which can be used for the wiring, there are only two types: metallic wiring for the gate of TFT, and metallic wiring connected to the source and drain of TFT. Although it is possible to make other wiring in addition to them, it is not preferable because the cost will be increased in the manufacture. When the gradation voltage wiring V0 to V63 of the DA conversion circuit 173 is wired with one layer of metallic wiring layer in the horizontal direction on the page space, the data bus wiring Dbus to be wired in the vertical direction on the page space to intersect the metallic wiring layer is to be wired through the use of only the remaining one layer metallic wiring layer. When the bus is wired through the use of only one layer, since the mutual wiring cannot be overlapped for wiring, the width and the interval of the wiring are to be included, as they are, in the width Wx of the DA conversion circuit in the horizontal direction on the page space. Also, since the liquid crystal display has as large a substrate as a few centimeters to several tens centimeters unlike LSI, the wiring interval or the wiring width become a numerical value higher than that of the LSI by a figure or more. Under the present circumstances, it is frequently about 4 μm.

In contrast to that, the width Wx of the DA conversion circuit is restrained by a pitch (=pitch of the signal line 152) of the display electrode 155. When the signal circuits 158 and 159 are arranged above and below the display area as shown in FIG. 13, a relation of $Wx \leqq 2 \times Px$ must be satisfied. In this respect, when the signal circuit is arranged only either above or below the signal circuit, a relation of $Wx \leqq Px$ must be satisfied.

Even in the case where $Wx > 2 \times Px$, it is possible to connect the signal line 152 to the output S1 to S3 by preparing wiring for converting the pitch, but the number of actual signal lines 152 is generally as large as hundreds to more than thousand. After all, since the area for the wiring for converting the pitch becomes enormous, this not realistic.

In the case of, for example, a 4 inch diagonal, color VGA (Vertical 480 pixels, Horizontal 640×RGB) display, since the pitch Px of the signal line 152 is about 42 μm, the maximum value of the width Wx of the DA conversion circuit is 84 μm. When the rule of the wiring width and wiring interval of the metallic wiring is 4 μm, since six pieces of Dbus wiring need (4 μm in width+4 μm in interval)×6 pieces=48 μm, an area of 57% of the width Wx of the DA conversion circuit is occupied only by the wiring, and the width which can be used for places for arranging all the TFTs and contact holes for connecting the TFT to the wiring is limited to 36 μm corresponding to the remaining 43%. As a result, it becomes difficult to lay out the circuit.

In the liquid crystal display constituted by the a-Si TFT, since there was only a pixel TFT at a place where the TFT is formed, the n-channel TFT had only to be formed. On the other hand, in the liquid crystal display constituted by Poly-Si TFT, the driving circuit is constituted by both n-channel and p-channel in many cases. Since, however, when TFTs of both n-channel and p-channel are used, the number of processes in the manufacture is increased, the cost will be higher than when constituted by only n-channel or only p-channel. Therefore, all the driving circuits are also preferably constituted by only the n-channel or only the p-channel.

FIG. 16 shows a circuit diagram for a 6-bit DA conversion circuit constituted by only the n-channel TFT. When the conversion circuit is constituted by only the n-channel TFT 183, the TFT is capable of only performing an operation which turns ON when the gate potential is high, and turns OFF when it is low, and therefore, in addition to 6-bit logic voltage, 6-bit logic voltage of their inversion signal will be required. For this reason, in this structure, 12 pieces of data bus wiring Dbus will be required. In the case of, for example, a 4 inch diagonally, resolution VGA (Vertical 480 pixels, Horizontal 640×RGB) display, since the pitch Px of the signal line 152 is about 42 μm, the maximum value of the width Wx of the DA conversion circuit is 84 μm. When the rule of the wiring width and wiring interval of the metallic wiring is 4 μm, since six pieces of Dbus wiring will require (4 μm in width+4 μm in interval)×12 pieces=96 μm, it cannot be accommodated in the width Wx of the DA conversion circuit. Further, a place for arranging all the TFTs and contact holes for connecting the TFT to the wiring cannot be secured. Accordingly, in the present wiring rule of about 4 μm, it is exceedingly difficult to form the 6-bit DA conversion circuit.

When the pitch Px of the display electrode is enlarged in order to enlarge the width Wx of the DA conversion circuit, it becomes impossible to display a fine image. For this reason, the performance of resolution of the liquid crystal display will be degraded, and this is not preferable.

Also, in FIG. 13, there is a method for dividing the signal circuit 158 into two circuits to pile up in the vertical direction on the page space, and in the case of this method, the signal circuit width Wy of FIG. 14 is increased to twice. When the signal circuit width Wy of FIG. 14 is large, a large area which does not contribute to image displaying is to exist in the peripheral portion of the display area 156. This limits degrees of freedom of size of applied products to the display and of position for arranging the display within the applied products, which is not desirable.

Also, since piling up the signal circuit 158 in the vertical direction on the page space increases wiring to be routed within the signal circuit, structure in which width and interval of the wiring are further limited will be given. The same is applicable to the signal circuit 159.

SUMMARY OF THE INVENTION

It is an object of the present invention to provide an image display which forms a pixel TFT and a driving circuit through the use of only a channel type TFT of either n-channel or p-channel, capable of poly-gradation display.

According to the present invention, there is provided an image display, comprising: an image display unit (display area 6) constituted by a plurality of pixels (Speaking in FIG. 1 to be described later, display electrode 5, hereinafter indicated reference symbol of the component of FIG. 1 corresponding in parentheses); a plurality of signal lines (signal line 2,3) arranged within the image display unit in order to input the display signal to the pixel; gradation voltage line groups (V0 to V63) to which gradation voltage that is an analog value is applied; switching means (switch matrix 11, 12) provided for each of the signal lines in order to selectively connect any of gradation voltage lines to which predetermined gradation voltage is applied from the gradation voltage line group to the signal line; a switch driving line for driving the switching means; decoding means (decoder 15, 16) for driving the switch driving line based on the display signal data inputted in digital form; and switching means selecting means (shift register 13, 14) for selectively inputting a driving signal inputted to the switch driving line to the plurality of switching means, wherein the pixel, the signal line, the switching means, the decoding means, and the switching means selecting means are formed on the same substrate, and wherein the pixel, the switching means, the decoding means and the switching means selecting means are constituted by only a single channel transistor of either n-channel or p-channel.

In this case, the switching means is preferably constituted by at least one first thin film transistor for connecting the gradation voltage line to the signal line, and at least one second thin film transistor for selecting the switches through a selection signal from the switching means selecting means.

Further, in the image display, the switching means is preferably arranged at each intersection of the switch driving line and a trigger line for transmitting a selection signal from the switching means selecting means to the switching means; at least one first thin film transistor which is the switching means connects any of the gradation voltage line groups to any of output wiring; and the second thin film transistor which is any of the gradation voltage line groups is connected to any of the trigger lines and any of the switch driving lines.

Further, in the image display, at the output unit of a circuit constituting the decoding means, a boot-strap-circuit is preferably provided.

DETAILED DESCRIPTION OF THE PREFERRED EMBODIMENTS

Hereinafter, with reference to the accompanying drawings, the detailed description will be made of preferred embodiments of image display according to the present invention.

First Embodiment

Figure 1:
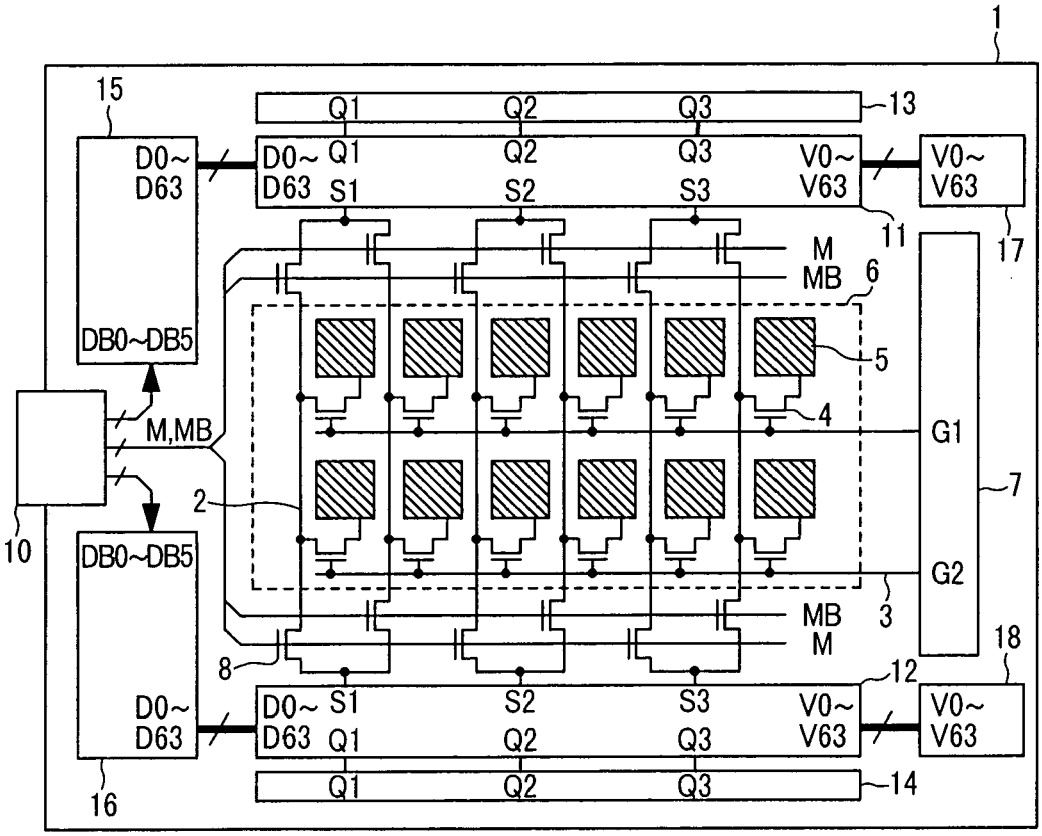
FIG. 1 is a structural view showing a liquid crystal display according to a first embodiment of the present invention.

FIG. 1 shows the structure of the first embodiment of the present invention. FIG. 1 shows a liquid crystal display obtained by integrally forming a pixel TFT of n-channel TFT and a driving circuit on a glass substrate. Also, FIG. 1 shows a liquid crystal display capable of inputting a 6-bit digital image signal to display 6-bit gradation. On top of the glass substrate 1, a plurality of signal lines 2, and a plurality of scanning lines 3 are formed in the vertical direction on the page space and in the horizontal direction on the page space respectively in a matrix shape, and for each intersection, a pixel TFT 4 which is a n-channel TFT and a display electrode 5 are formed. FIG. 1 shows six pieces of signal line 2, two pieces of scanning lines 3, 6×2=12 pieces each of the pixel TFTs 4 and the display electrodes 5, and generally, their numbers are much larger, and when the resolution is, for example, color VGA, there are 1920 pieces of the signal line 2, 480 pieces of scanning lines 3, and 921,600 pieces each of the pixels TFT4 and the display electrodes.

On the periphery of the display area 6 constituted by these parts, there is formed a driving circuit. On the upper side of the page space of the display area 6, and on the lower side thereof, there are formed a switch matrix 11 and a shift register 13, and a switch matrix 12 and a shift register 14 respectively. On the left side of the page space of the display area 6, there are formed decoders 15 and 16, and a signal input terminal 10. On the right side of the page space of the display area 6, there are formed a scanning circuit 7, gradation voltage sources 17 and 18, and output G1 to G2 of the scanning circuit 7 is connected to a scanning line 3. Between the display area 6 and the switch matrix 11,12, there is arranged a TFT8 for performing a function of converting into AC, and the source and drain of the TFT 8 are connected to output S1 to S3 of the switch matrix and the signal line 2 respectively. A gate of the TFT8 is alternately connected to wiring M, MB for a signal for converting into AC.

A 6-bit digital image signal inputted from a signal input terminal 10 is decoded by a decoder 15, 16 and output D0 to D63 from the decoder 15, 16 is transmitted to the switch matrix 11, 12 through 64 pieces of wiring respectively. Voltage at 64 stages of V0 to V63 to be generated by the gradation voltage source 17, 18 and outputted is supplied to the switch matrix 11, 12 through 64 pieces of wiring respectively. Output Q1 to Q3 from the shift register 13, 14 is connected to the switch matrix 11, 12 respectively.

In this respect, in FIG. 1, the power source wiring, control lines and a partial wiring not required for description have been omitted. Also, the signal input terminal 10 may be formed on the right side on the page space. Also, the arrangement relationship for each driving circuit and the signal input terminal 10 may be reversed up or down and left or right, and may be rotated by 90°.

Figure 2:
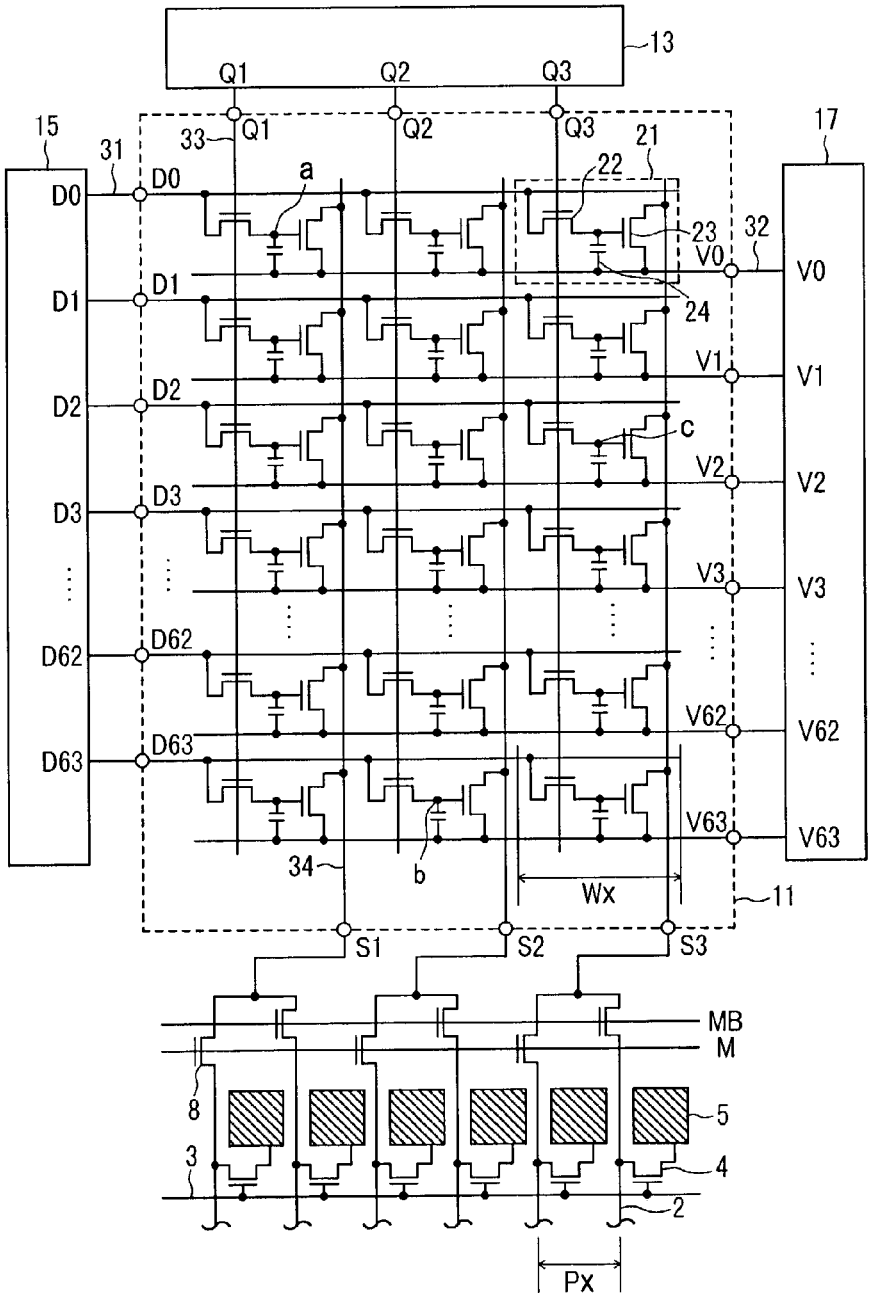
FIG. 2 is a structural view for a switch matrix shown in FIG. 1.

FIG. 2 shows the structure of the switch matrix 11. On the switch matrix 11, there are wired a decoding signal line 31, a gradation voltage line 32 in the horizontal direction, and a trigger line 33 and an output line 34 in the vertical direction respectively in a matrix shape, and further there is two-dimensionally arranged a switch unit 21 constituted by two TFTs 22 and 23 and one capacitor 24. Numbers of wiring of the trigger line 33 and the output line 34 and a number of the switch unit 21 in the horizontal direction vary in proportion to the number of the display electrodes. Also, numbers of the decoding signal line 31 and the gradation voltage line 32 and the number of the switch unit 21 in the vertical direction are $2^n$ pieces respectively where n is a bit number of the display gradation. All the TFTs for the switch matrix are formed by n-channel TFTs.

The source of the TFT22 is connected to any of the decoding signal lines 31, the gate is connected to any of the trigger lines 33, and the drain of the TFT22 is connected to one side electrode of the capacitor 24 and the gate of the TFT23. The other side electrode of the capacitor 24 is connected to any of the gradation voltage lines 32 to be in an AC-grounded state. The source of the TFT23 is connected to any of the gradation voltage lines 32, and the drain of the TFT23 is connected to any of the output lines 34. As regards a function of the switch unit 21, when a trigger pulse comes from the shift register 13 through the trigger line 33, output from the decoder 15 to be supplied through the decoding signal line 31 is latched into the capacitor 24 by the TFT22, and when the signal thus latched is at high voltage, the TFT23 is turned ON, and output voltage from the gradation voltage source 17 to be supplied through the gradation voltage line 32 is supplied to the signal line 2 through the output line 34. The structure of the switch matrix 12 is also quite the same.

Figure 3:
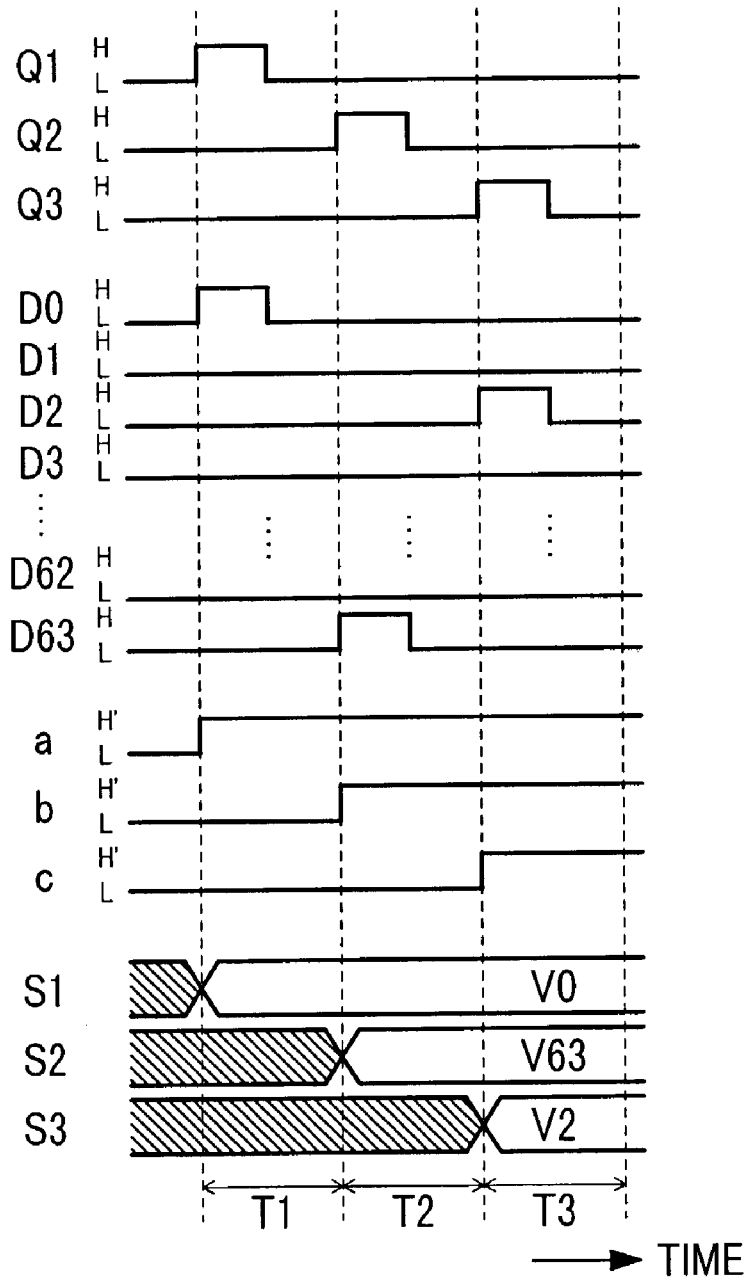
FIG. 3 is a timing view showing a DA conversion operation of the switch matrix having the structure shown in FIG. 2.

FIG. 3 shows a DA conversion operation in the switch matrix 11. During a time period of T1 to T3, a pulse occurs in output Q1 to Q3 of the shift register 13. In synchronism therewith, the decoder 15 generates a decoding signal corresponding to the image signal to output D0 to D63. The decoding signal is a signal that correspondingly to a value 0 to 63 of a 6-bit image signal to be inputted to input DB0 to DB5 of the decoder 15, only one specified output becomes a high (H) level, and all other output that does not correspond becomes a low (L) level. In FIG. 3, there is described a decoding signal when a digital image signal of <0, 63, 2> is inputted to the decoder 15 in order.

Since when in a time period T1, a trigger is inputted from output Q1 of the shift register 13, output D0 from the decoder 15 is at H level and others are at L level, voltage at H' level is latched at point a of FIG. 2. In this case, H' level represents voltage lower by threshold voltage Vth of TFT than voltage at H level, and the same is applicable thereafter. Assuming that voltage at H' level is sufficient voltage to turn ON the TFT 23, voltage V0 of the gradation voltage line 32 is outputted at S1 of the switch matrix 11, and the output will be retained until a new trigger at Q1 comes. In order to make the voltage at H' level sufficient to turn ON the TFT 23, voltage at H level can be raised or a TFT having low threshold voltage Vth can be used.

In a time period T2, since when a trigger is inputted from output Q2 of the shift register 13, output D63 of the decoder 15 is at H-level and others are at L-level, voltage at H' level is latched at point b of FIG. 2. Then, voltage V63 of the gradation voltage line 32 is outputted at S2, and the output will be retained until a new trigger comes from output Q2.

In a time period T3, since when a trigger is inputted from output Q3 of the shift register 13, output D2 of the decoder 15 is at H level and others are at L level, voltage at H' level is latched at point c of FIG. 2. Then, voltage V2 of the gradation voltage line 32 is outputted at S2, and the output will be retained until a new trigger comes from output Q3.

When the operations in the above-described time period T1 to T3 are completed, analog voltage <V0, V63, V2>corresponding to a digital image single <0, 63, 2> inputted to the decoder can be generated to output S1 to S3 of the switch matrix. Likewise, even another digital image signal can be converted to corresponding analog voltage.

In this respect, in this case, the H-level represents higher voltage of the binary digital signal, and the L-level represents lower voltage. The same holds tree hereinafter.

In this respect, there is a clearance in the pulse at output Q1 to Q3 of the shift register 13, but there may be no clearance.

Figure 4:
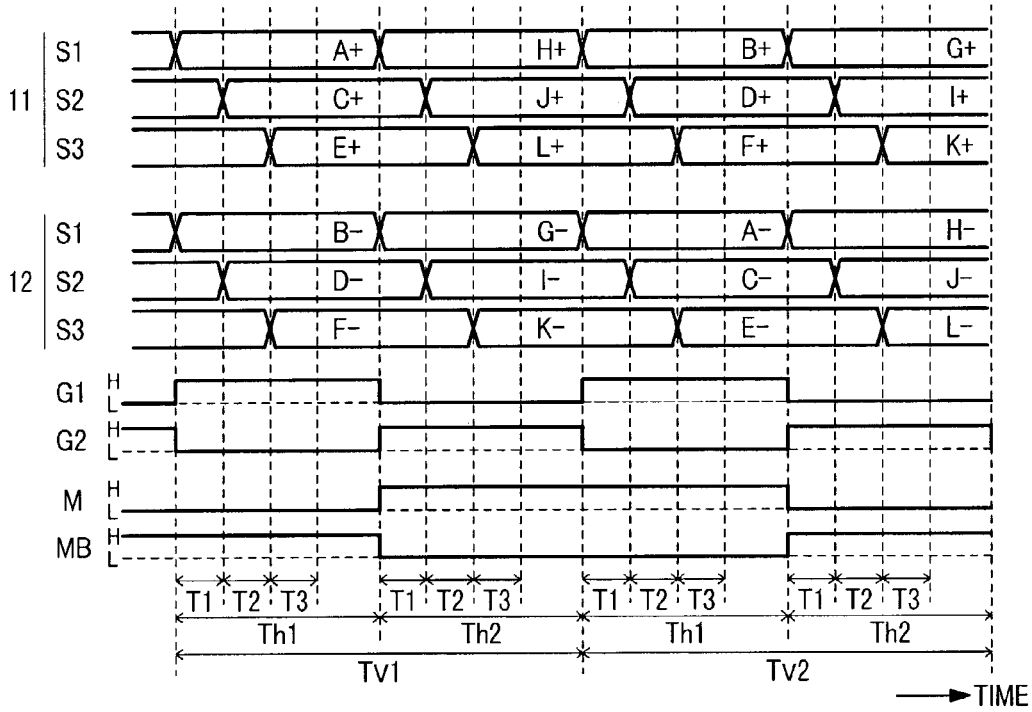
FIG. 4 is a view showing a waveform for driving the liquid crystal display having the structure of FIG. 1.

FIG. 4 shows a waveform for driving the liquid crystal display of FIG. 1. In order to convert into AC, the gradation voltage source 17 generates + side voltage to output V0 to V63, and the gradation voltage source 18 generates − side voltage. Therefore, the switch matrix 11 generates + side analog voltage correspondingly to a digital image signal inputted to the decoder 15, and the switch matrix 12 generates − side analog voltage correspondingly to a digital image signal inputted to the decoder 16. In FIG. 4, symbols of "A" to "L" represent voltage to be applied to the display electrode 5 while symbols of "+" and "−" represents whether the voltage is on the + side or on the − side.

In a first line period Th1 of a first frame period Tv1, a pulse at H-level is outputted to output G1 of the scanning circuit 7. In this time period, the switch matrix 11, 12 performs the DA conversion operation described in FIG. 3, and to output S1, S2 and S3 of the switch matrix 11, A+, C+ and E+ are outputted respectively while to output S1, S2 and S3 of the switch matrix 12, B−, D− and F− are outputted respectively. A wiring M is at L-level, while a wiring MB is at H-level, and correspondingly to these voltages, TFT 8 operates to distribute output voltage of the switch matrix 11, 12 to a signal line 2. Analog voltage outputted to the signal line 2 is sampled by the display electrode 5 further connected through pixel TFT 4 connected to output G1 from the scanning circuit.

In a second line period Th2 of a first frame period Tv1, a pulse at H-level is outputted to output G2 of the scanning circuit 7. In this time period, the switch matrix 11, 12 performs the DA conversion operation described in FIG. 3, and to output S1, S2 and S3 of the switch matrix 11, H+, J+ and L+ are outputted respectively while to output S1, S2 and S3 of the switch matrix 12, G−, I− and K− are outputted respectively. A wiring M is at H-level, while a wiring MB is at L-level, and correspondingly to these voltages, TFT 8 operates to distribute output voltage of the switch matrix 11, 12 to a signal line 2. Analog voltage outputted to the signal line 2 is sampled by the display electrode 5 further connected through pixel TFT 4 connected to output G2 from the scanning circuit.

Figure 5A:
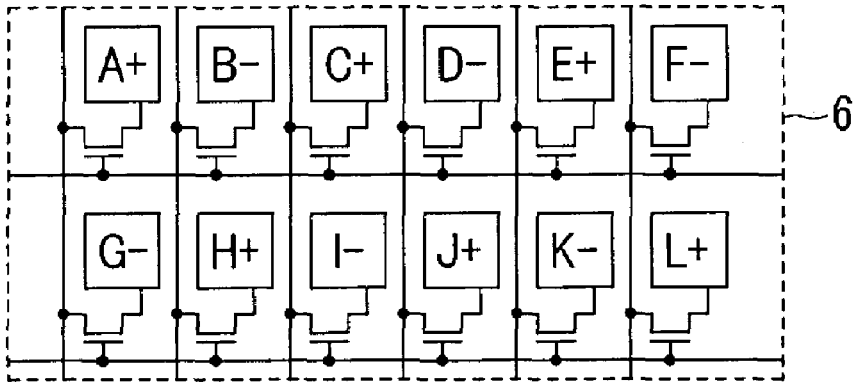
FIG. 5A is a view showing result of an image whose display area is displayed by the driving waveform of FIG. 4.

At the conclusion of one frame period, as shown in FIG. 5A, voltage can be supplied to the display electrode 5 for the entire display area 6 to display the image. Generally, there are more scanning lines 3 than in FIG. 1, and there exist many line periods within one frame period. For example, when the resolution is color VGA, there exist 480 pieces of scanning lines 3 and 480 or more frame periods.

In the next second frame period Tv2, the phase of a signal in the wiring M and wiring MB is made opposite to the period of the first frame period Tv1. As in the case of the first frame period, in the first line period Th1 and the second line period Th2, the switch matrix 11, 12 performs the DA conversion operation, and the scanning circuit 7 outputs a pulse to G1 to G2.

Figure 5B:
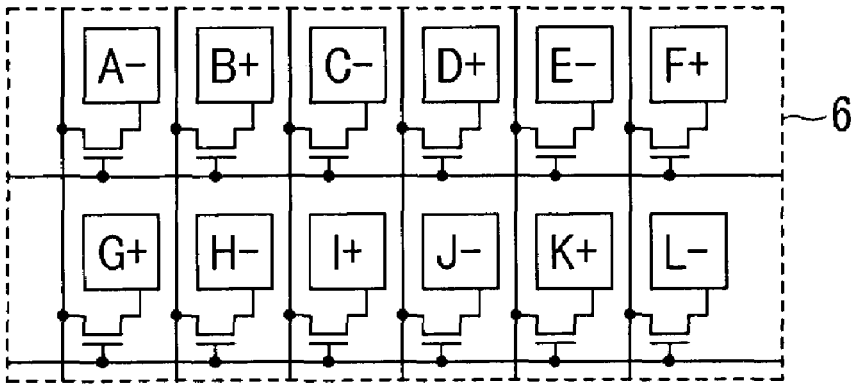
FIG. 5B is a view showing result of an image whose display area is displayed by the driving waveform of FIG. 4.

At the conclusion of the second frame period, as shown in FIG. 5B, voltage can be supplied to the display electrode 5 for the entire display area 6 to display the image. However, the polarity of voltage is opposite to that of FIG. 5A. The above-described operation of the first frame period Tv 1 and an operation of the second frame period Tv 2 are alternately performed, whereby voltage to be supplied to the display electrode 5 can be converted into AC.

Figure 6:
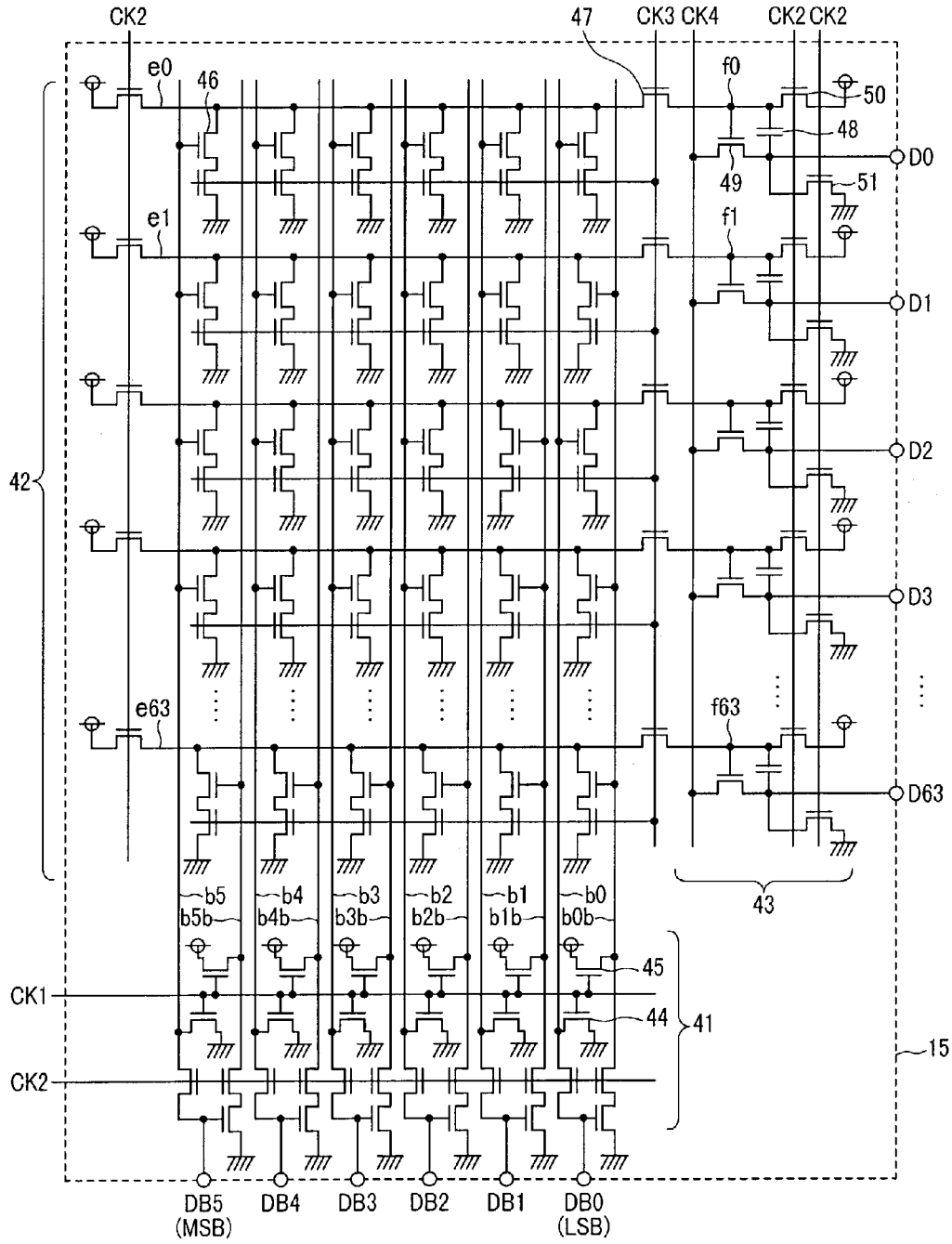
FIG. 6 is a circuit block diagram for a decoder shown in FIG. 1.

FIG. 6 shows a circuit diagram for a 6-bit decoder 15 constituted by an n-channel TFT. A decoder circuit 15 is composed of: four types of clock input CK1 to CK4; a plurality of n-channel TFTs; and a capacitor. A portion of a circuit 41 is a circuit for creating an inverted signal at decoder input DB0 to DB5. This circuit 41 latches data inputted to DB0 to DB5 to generate a non-inverting signal at wiring b0 to b5 and an inverted signal at wiring b0*b* to b5*b*. A portion of a circuit 42 is a circuit for a decoding operation, and generates a decoding signal at wiring e0 to e63 in accordance with signals from the wiring b0 to b5 and wiring b0*b* to b5*b*. A portion of a circuit 43 is a boot-strap-circuit, and is capable of restoring a signal at H' level of the wiring e0 to e63 which has lowered by an amount corresponding to threshold voltage Vth of TFT to a signal at H level.

Figure 7:
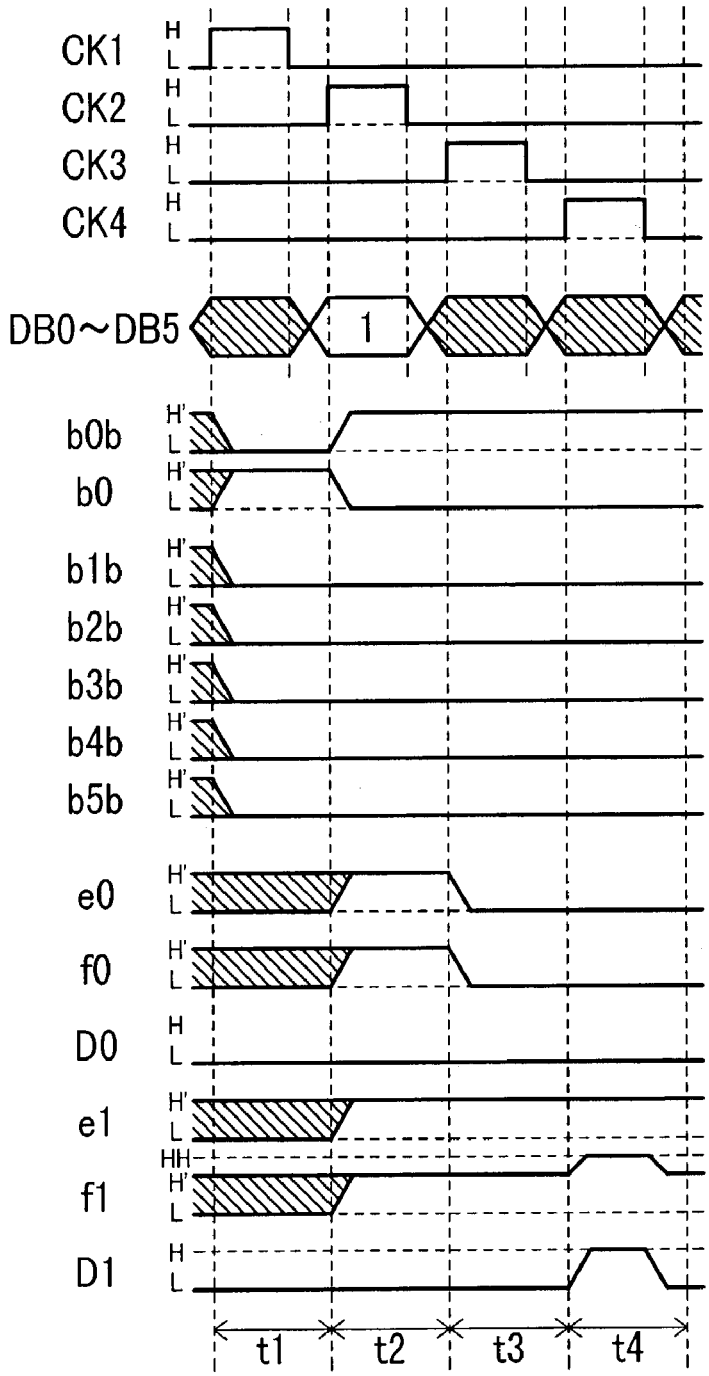
FIG. 7 is a view showing an example of a decoding operation of the decoder shown in FIG. 6.

FIG. 7 is a view showing an example of a decoding operation of the circuit of FIG. 6, showing a decoding operation when the input signal is "1". In a time period t1 to t4, to the clock input CK1 to CK4, a pulse is supplied in turn, and at the conclusion of the time period of t4, the decoding operation is completed. In the time period t1, a pulse from the clock input CK1 turns ON the TFT 44, 45 to reset the wiring b0 to b5 and the wiring b0*b* to b5*b*.

In the time period t2, by means of a pulse at the clock input CK2, signals of the wiring b0 to b5 and wiring b0*b* to b5*b* are reversed only for a bit in which data inputted to the DB0 to DB5 of the decoder 15 is H. In FIG. 7, since the input signal is "1", only DB0 is reversed. Also, in the time period t2, TFT 49, 50, 51 turns ON, and voltage of the wiring e0 to e63 and wiring f0 to f63 is reset to H'-level, and output of D0 to D63 of the decoder 15 is reset to the L-level. This reset operation may be performed in the time period t1 through the use of the clock input CK1.

In the time period t3, by means of a pulse of the clock input CK3, voltage of the wiring e0 to e63 and wiring f0 to f63 which do not correspond to the input signal is lowered to the L-level. Since six pieces of TFTs 46 connected in parallel with the wiring e1 corresponding to the input signal "1" are all OFF, the H' level is retained. Since, however, six pieces of TFTs 46 connected in parallel with other wiring e0, e2*e* to 63 corresponding to the input signal "1" have one or more TFTs which turns ON, all becomes L-level. Since TFT 47 is ON, the same holds true with regard to the wiring f0 to f63.

In the time period t4, voltage of wiring f1 at H'-level is outputted to output D1 of the decoder 15 in H-level by means of a boot-strap-operation. Since the potential of the wiring f1 is at H'-level, when this potential is assumed to be able to turn ON a TFT49, a current flows from the clock input CK4 at H-level to output D1 to raise the potential at D1, and the potential thus raised is fed back to wiring f0 through the capacitor 48. As a result, the potential rises to the maximum (twice the potential at H-level-threshold voltage Vth of TFT). This potential is referred to as HH-level, and hereinafter, the same holds true.

When this potential at the HH-level is assumed to be higher by Vth or more than the potential at H-level, output at H-level can be generated at output D1 of the decoder 15. In order to satisfy the above-described assumptive condition, Vth can be restrained low or the voltage at H-level can be raised. Since the potential at wiring f0, f2 to f63 is at L-level, the TFT49 remains to be OFF, and even if a pulse comes to the clock input CK4, output D0, D2 to D63 of the decoder 15 remains to be at L-level.

Similarly, even to other input signals to the decoder 15, of output D0 to D63, only output corresponding becomes at H-level, and others become all at L-level. Also, in the case of a periodic pulse in which the clock input CK1 comes after the clock input CK4, the clock input CK1 to CK4 can be used in rotation. Thereby, it is possible to form a decoder for latching an input signal at four different timing. Also, there is a clearance in the pulse of the clock input CK1 to CK4, but there may be no clearance. Even the decoder 16 can be formed in accordance with the circuit configuration of FIG. 6 and operate in the waveform of FIG. 7.

In this respect, the decoder 15 becomes a comparatively large circuit, but since it can be arranged at a different position from the switch matrix 11 and the shift register 13, the pitch Px of the signal line 2 is not affected. In FIG. 1, the decoder 15 is arranged at a left side of the display area 6.

Figure 8:
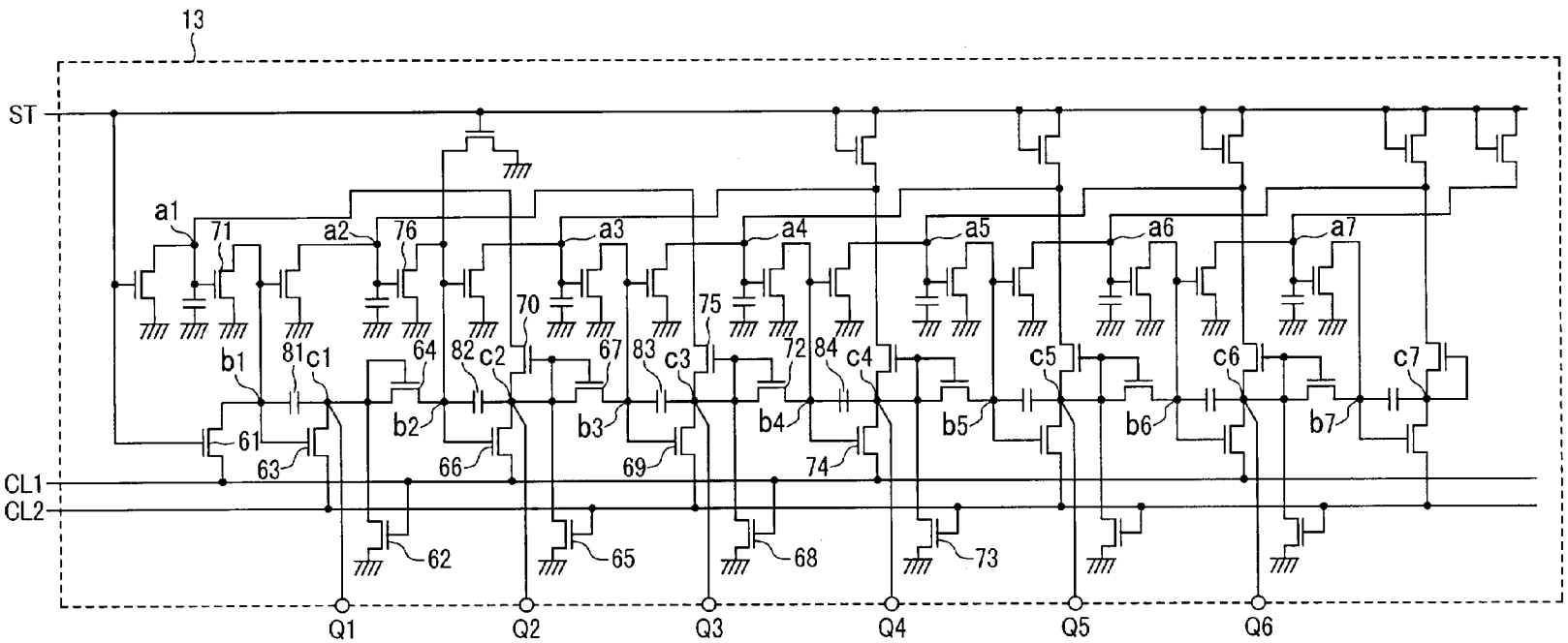
FIG. 8 is a circuit block diagram for a shift register shown in FIG. 1.

FIG. 8 shows a circuit diagram for a shift register 13 constituted by the n-channel TFT. The shift register 13 is composed of: clock input CL1 and CL2; start signal input ST; a plurality of n-channel TFT; and a capacitor. For the shift registers of FIG. 8, there are shift registers for six output: Q1 to Q6, and when as output necessary for the shift register 13, there are three output, only output of Q1 to Q3 can be utilized. Also, generally, there are more stages of the shift register, and in the case of, for example, the color VGA in resolution, the output from the shift register amounts to 960 output of Q1 to Q960.

Figure 9:
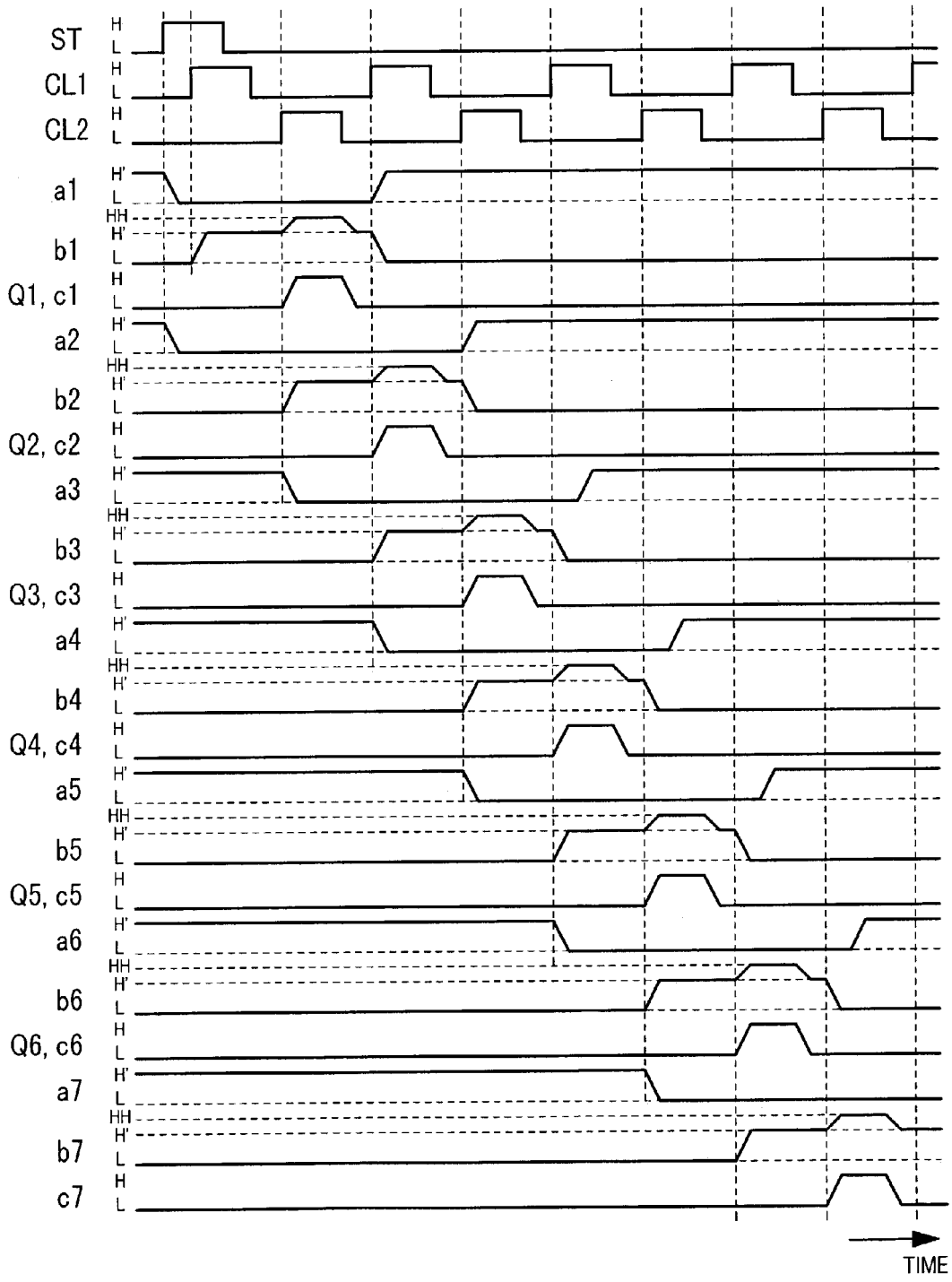
FIG. 9 is a view showing a driving waveform and an operation waveform of the shift register shown in FIG. 8.

FIG. 9 shows driving waveform and operation waveform of the shift register of FIG. 8. To the clock input CL1 and CL2, a clock pulse is alternately inputted at all times, and a start pulse is inputted to start signal input ST by overlapping with the pulse of the clock input CL1, whereby a shift register operation is started. At this time, nodes a2 to a7 are set to H'-level, whereby nodes b2 to b7 are reset to L-level. Only node b1 is set to H'-level by a TFT61, and at the same time, node c1 is set to L-level by a TFT62, whereby a capacitor 81 is charged and a TFT63 is turned ON to prepare for the shift operation.

Next, when a pulse is inputted to the clock input CL2, since the TFT63 is ON, the node b1 and the node c1 are caused to be at HH-level and at H-level respectively by a capacitor 81. At this time, to the output Q1 of the shift register 13, voltage of the node c1 is outputted as a pulse. Also, the node b2 is caused to be at H' level by the TFT64, and the node c2 is caused to be at L-level by the TFT65, whereby the capacitor 82 is charged to turn ON the TFT66 for preparing for the next shift operation.

Next, when a pulse is inputted to the clock input CL1, since the TFT66 is ON, the node b2 and the node c2 are caused to be at HH-level and at H-level respectively by a capacitor 82. At this time, to the output Q2 of the shift register 13, voltage of the node c2 is outputted as a pulse. Also, the node b3 is caused to be at H' level by the TFT67, and the node c3 is caused to be at L-level by the TFT68, whereby the capacitor 83 is charged to turn ON the TFT69 for preparing for the next shift operation. Further, the node a1 is caused to be at H'-level through the TFT70, and even if a pulse comes to the clock input CL2 next, the node a1 is fixed to L-level by the TFT71 such that the voltage at the node b1 is not increased.

Next, when a pulse is inputted to the clock input CL2, since the TFT69 is ON, the node b3 and the node c3 are caused to be at HH-level and at H-level respectively by a capacitor 83. At this time, to the output Q3 of the shift register 13, voltage of the node c3 is outputted as a pulse. Also, the node b4 is caused to be at H' level by the TFT72, and the node c4 is caused to be at L-level by the TFT73, whereby the capacitor 84 is charged to turn ON the TFT73 for preparing for the next shift operation. Further, the node a2 is caused to be at H'-level through the TFT75, and even if a pulse comes to the clock input CL1 next, the node a2 is fixed to L-level by the TFT76 such that the voltage at the node b2 is not increased.

By repeating the above-described operation, a pulse can be generated even to the output Q4 to Q6 of the shift register 13. The shift register 14 can be also formed in accordance with the circuit configuration of FIG. 8, and be operated at the waveform of FIG. 9. Also, there is a clearance in the pulse of the clock input CL1, CL2, but there may be no clearance.

The scanning circuit 7 shown in FIG. 1 can be formed in accordance with the circuit configuration of FIG. 8, and be operated at the waveform of FIG. 9. In this case, it is possible to correspond by replacing the output G1 to G2 of the scanning circuit 7 with output Q1 to Q2 of the shift register of FIG. 8.

Also, the scanning circuit 7 can be formed in accordance with the circuit configuration shown in FIG. 6, and be operated at the waveform of FIG. 7. In this case, it is possible to correspond by replacing the output G1 to G2 of the scanning circuit with decoder output D1 to D2 of FIG. 6.

Figure 10:
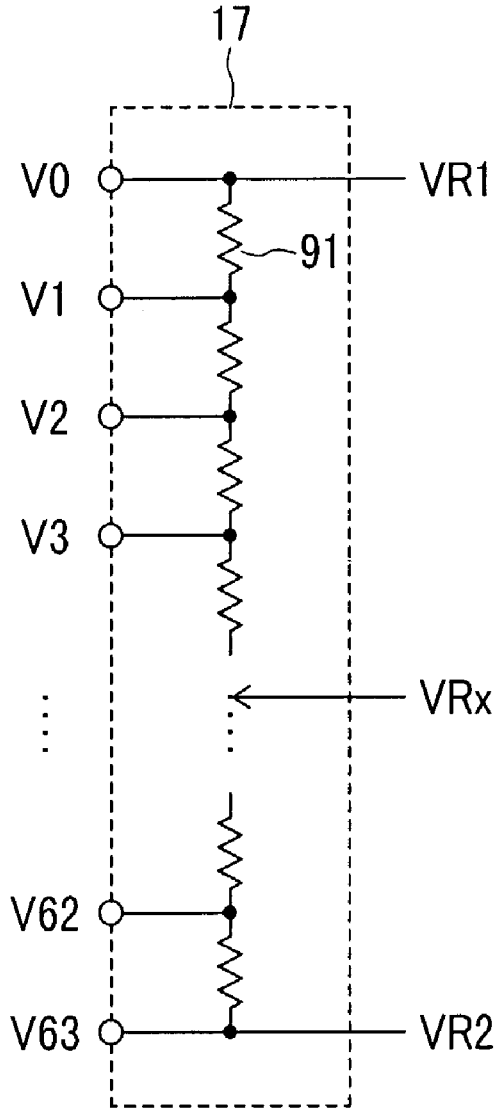
FIG. 10 is a circuit block diagram for a gradation voltage source shown in FIG. 1.

FIG. 10 shows the structure of a gradation voltage source 17. In this respect, a gradation voltage source 18 is also of the same structure. A plurality of resistance 91 are connected in series, to both ends of which two voltage VR1 and VR2 from the outside is supplied to part the voltage in 64 stages. Also, at some midpoint in resistance 91 connected in series, some other voltages VRx than voltages VR1 and VR2 may be supplied from the outside. The resistance 91 can be fabricated by drawing out thin film of silicon to be used for forming the source and drain of TFT or metallic wiring long. Also, when all voltages of 64 types: V0 to V63 are supplied from the outside, the gradation voltage sources 17 and 18 are not required.

Through the use of the switch matrix of FIG. 2, the decoder of FIG. 6, and the shift register of FIG. 8 which have been described above, in the image display shown in FIG. 1, all the TFTs for constituting the scanning circuit 7 which is each driving circuit, the switch 8, the switch matrices 11 and 12, the shift registers 13 and 14, and the decoders 15 and 16 together with the pixel TFT4 of the display area 6 can be constituted by n-channel TFTs.

Second Embodiment

Figure 11:
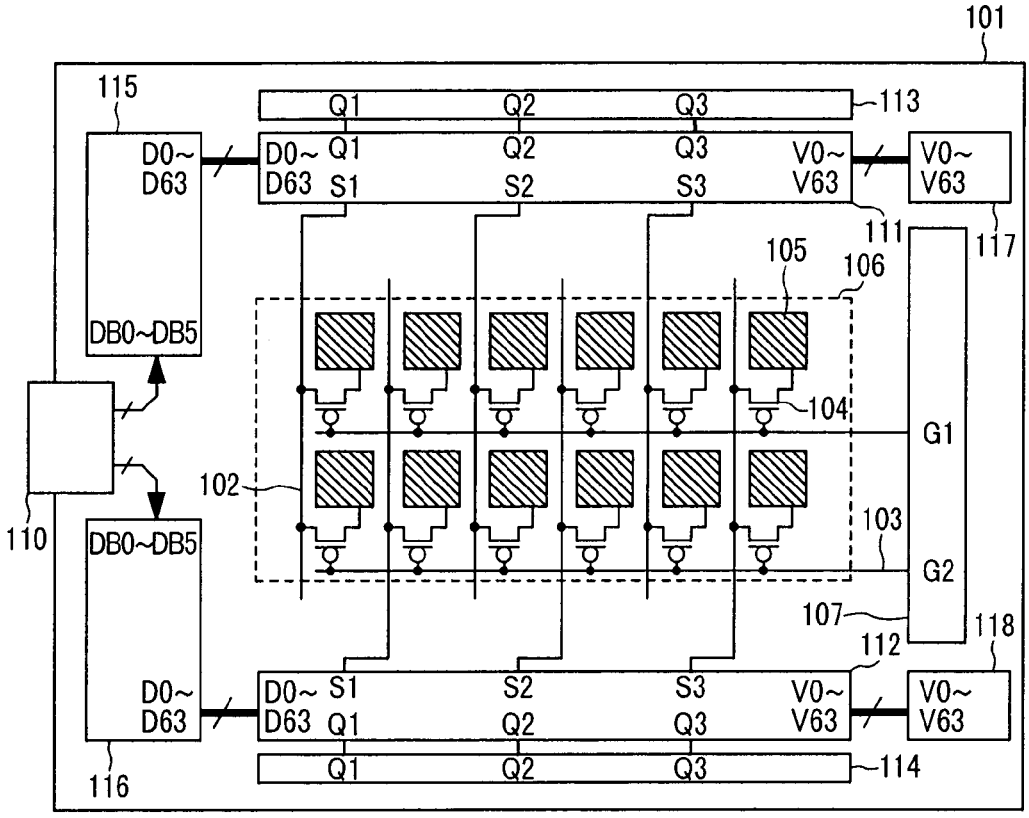
FIG. 11 is a block diagram for a LED display according to a second embodiment of the present invention.

FIG. 11 shows the structure of the second embodiment of the present invention. FIG. 11 shows a light emitting diode (LED) display obtained by integrally forming a pixel TFT of p-channel TFT and a driving circuit on a glass substrate. Also, FIG. 11 shows a LED display capable of inputting a 6-bit digital image signal to display 6-bit gradation. On top of the glass substrate 101, a plurality of signal lines 102, and a plurality of scanning lines 103 are formed in the vertical direction on the page space and in the horizontal direction on the page space respectively in a matrix shape, and for each intersection, a pixel TFT 104 which is a p-channel TFT and a pixel circuit 105 are formed. FIG. 11 shows six pieces of signal line 102, two pieces of scanning lines 103, 6×2=12 pieces each of the pixel TFTs 104 and the display electrodes 105, and generally, their numbers are much larger, and when the resolution is, for example, color VGA, there are 1920 pieces of the signal line 102, 480 pieces of scanning lines 103, and 921,600 pieces each of the pixels TFT104 and the pixel circuit 105.

On the periphery of the display area 106 constituted by these parts, there is formed a driving circuit. On the upper side of the page space of the display area 106, and on the lower side thereof, there are formed a switch matrix 111, 112, and a shift register 113, 114. On the left side of the page space of the display area, there are formed decoders 115 and 116, and a signal input terminal 110. On the right side of the page space of the display area, there are formed a scanning circuit 107, gradation voltage sources 117 and 118, and output G1, G2 of the scanning circuit 107 is connected to a scanning line 103.

In this respect, since the LED display is in no need of being converted into AC like the liquid crystal display, there is no circuit of being converted into AC, but voltage groups at the same potential are generated in the gradation voltage sources 117 and 118.

A 6-bit digital image signal inputted from a signal input terminal 110 is decoded by a decoder 115, 116 and output D0 to D63 from the decoder 115 is transmitted to the switch matrix 111, 112 through 64 pieces of wiring. Voltage at 64 stages of V0 to V63 to be generated by the gradation voltage source 117, 118 and outputted is supplied to the switch matrix 111, 112 through 64 pieces of wiring. Output Q1 to Q3 from the shift register 113, 114 is connected to the switch matrix 111, 112 respectively.

In this respect, in FIG. 11, the power source wiring, control lines and a partial wiring not required for description have been omitted. The signal input terminal 110 may be formed on the right side on the page space. Also, the arrangement relationship for each driving circuit and the signal input terminal 110 may be reversed up or down and left or right of the page space, and may be rotated by 90°.

Figure 12:
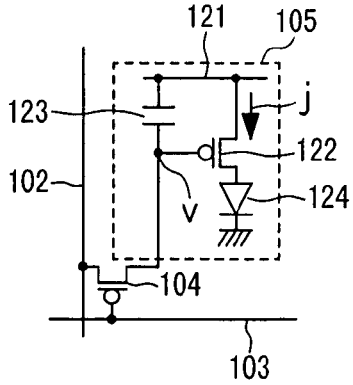
FIG. 12 is a view showing pixel circuit structure of the LED display shown in FIG. 11.
Figure 13:
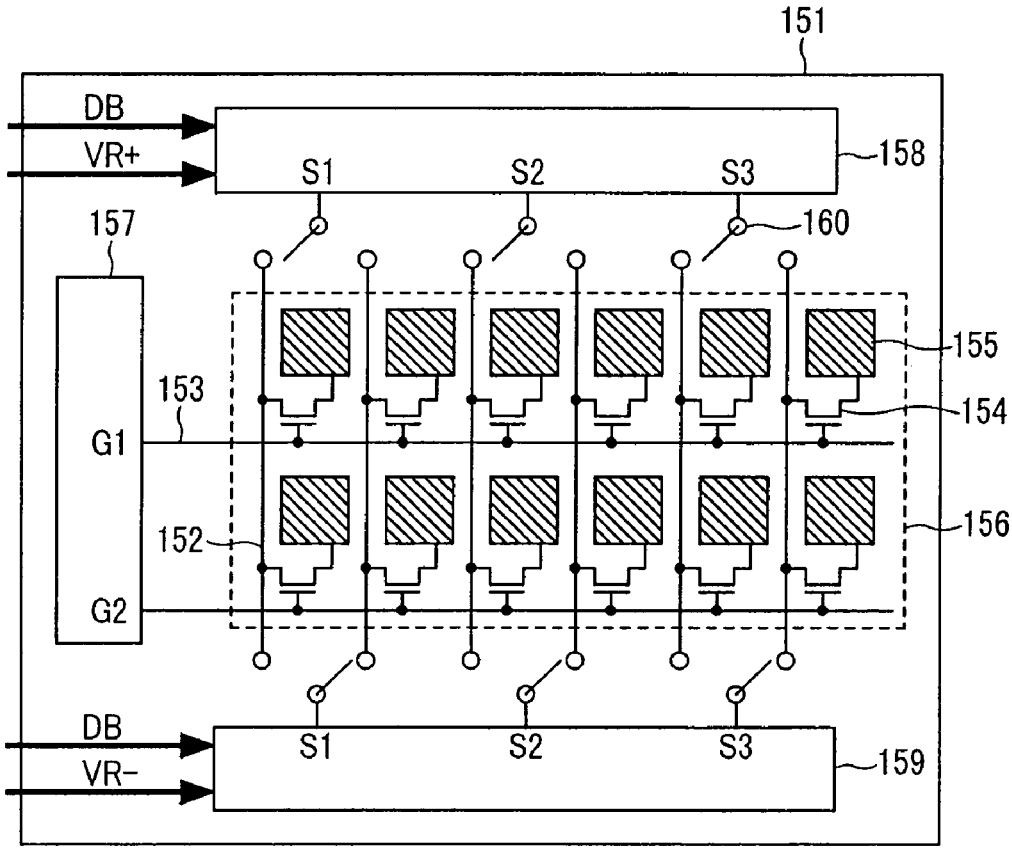
FIG.13 (PRIOR ART)
FIG. 13 is a block diagram showing a conventional active matrix type TFT liquid crystal display.
Figure 14:
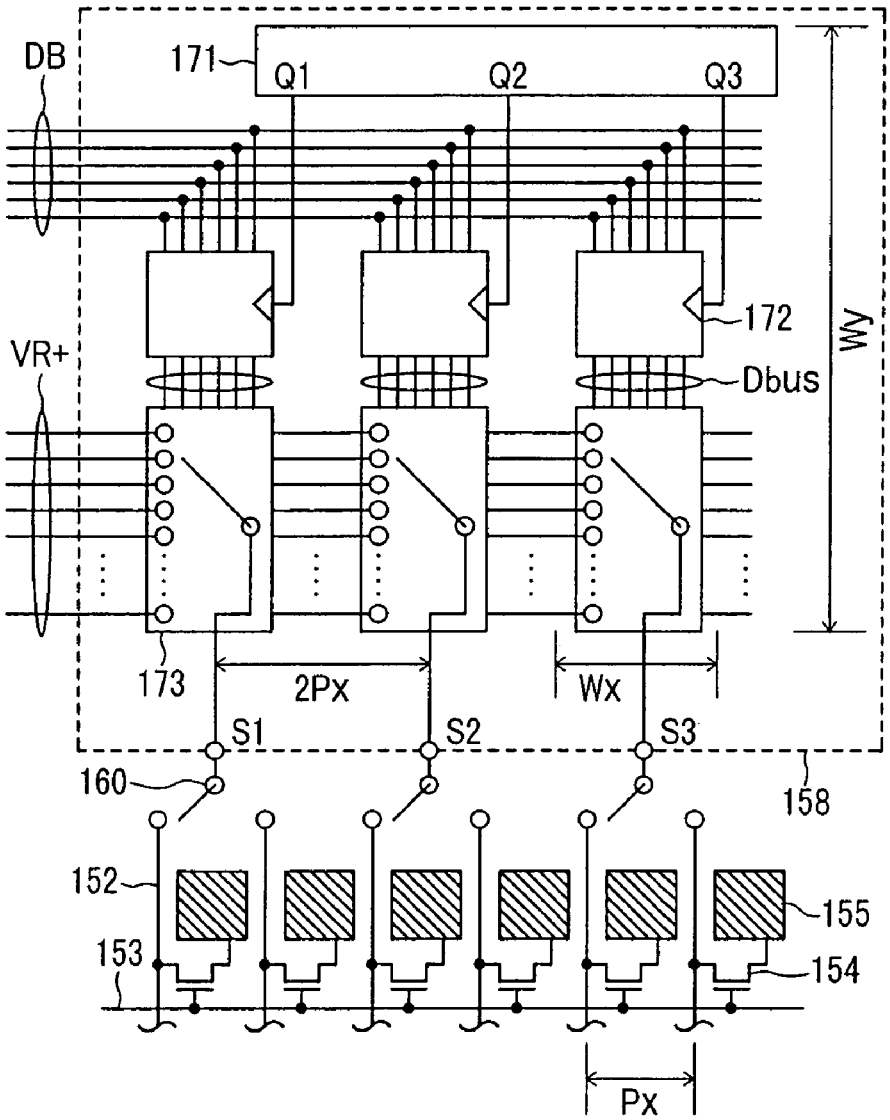
FIG.14 (PRIOR ART)
FIG. 14 is a view showing the structure of the signal circuit for the liquid crystal display shown in FIG. 13.
Figure 15:
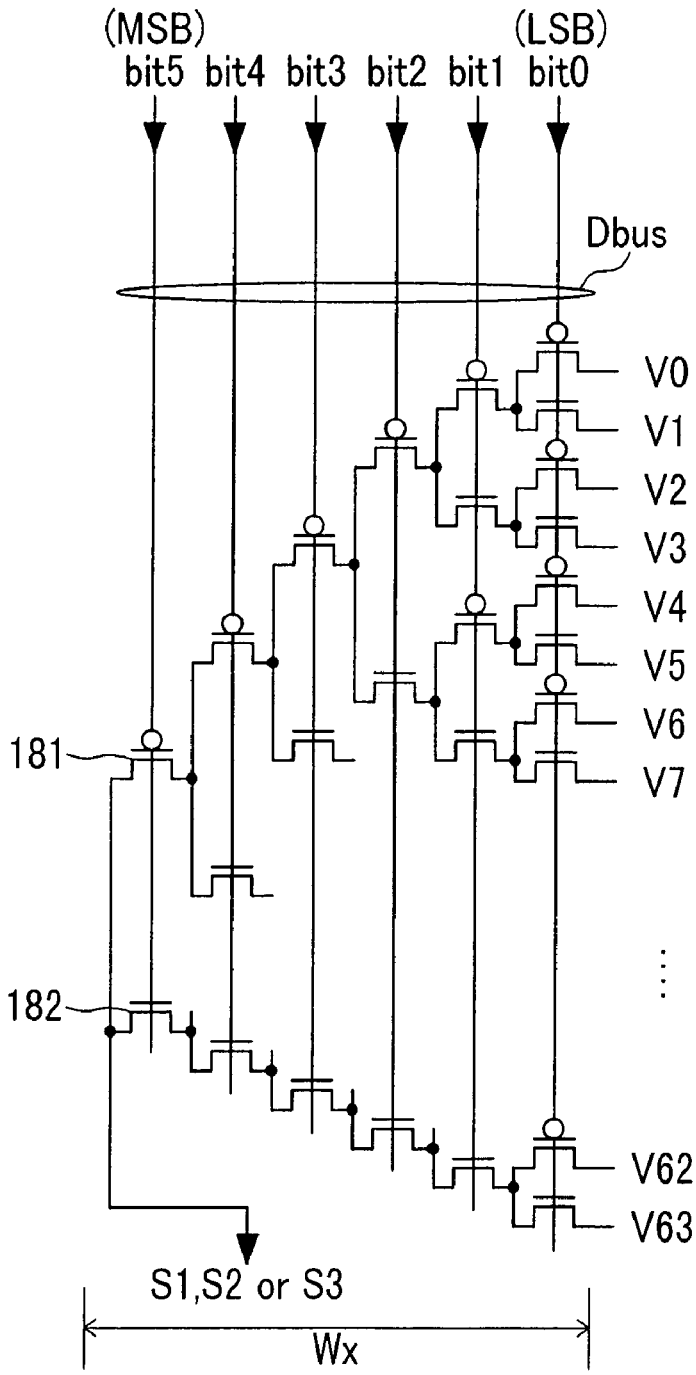
FIG.15 (PRIOR ART)
FIG. 15 is a circuit diagram showing the conventional 6-bit DA conversion circuit constituted by n-channel and p-channel TFTs.
Figure 16:
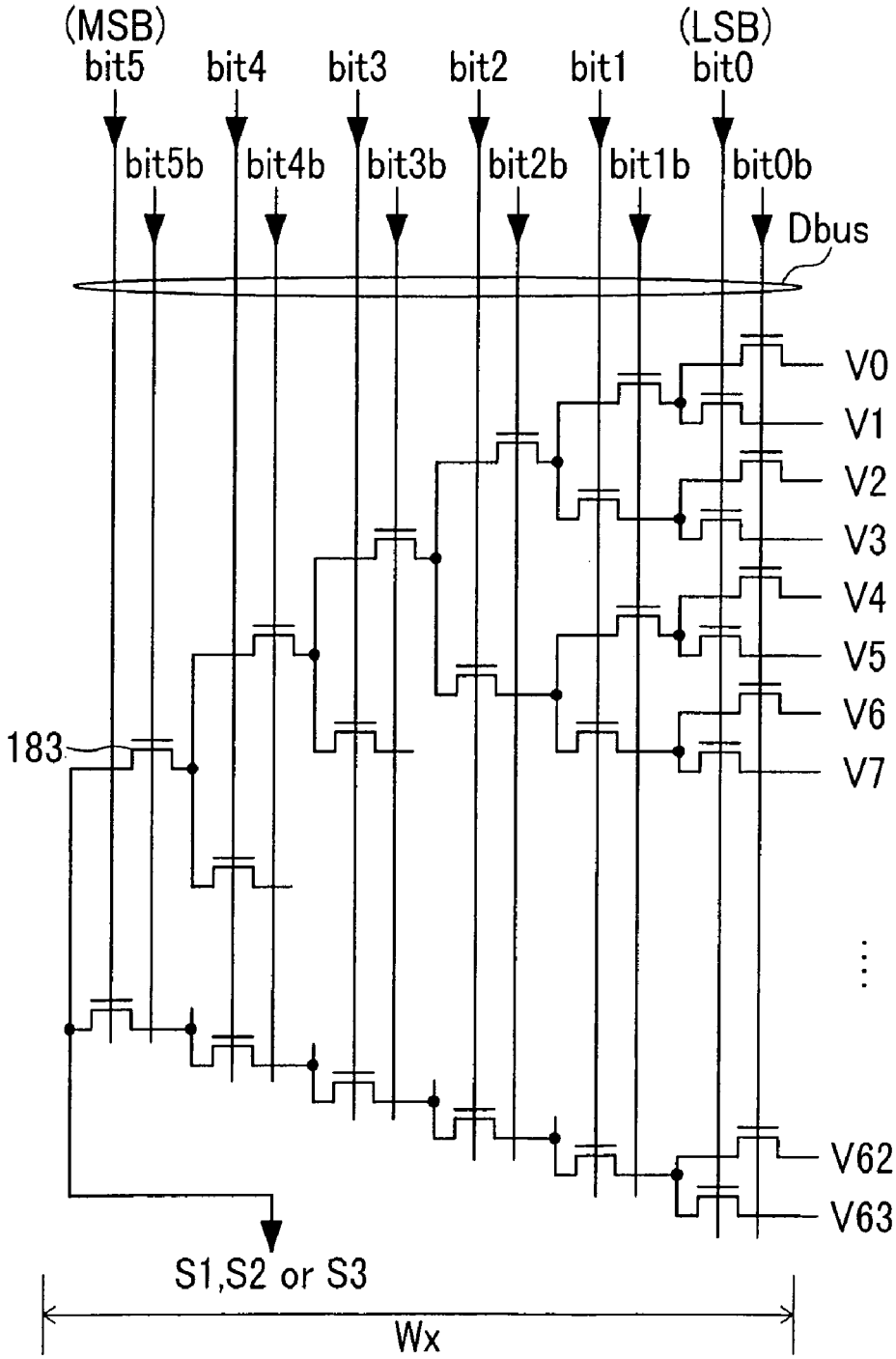
FIG.16 (PRIOR ART)
FIG. 16 is a circuit diagram showing the conventional 6-bit DA conversion circuit constituted by only n-channel TFT.

FIG. 12 shows the structure of a pixel circuit 105. The pixel circuit 105 is composed of: a LED power source line 121; a p-channel TFT 122; a capacitor 123; and an organic light emitting element 124 to be used as LED. A cathode wiring is not described in FIG. 11, but there is common cathode wiring for grounding the cathode of the organic light emitting element 124. As regards analog voltage supplied to the signal line 102, voltage at node V is sampled by TFT104 connected to the scanning line 103, and the voltage is retained by the capacitor 123. The voltage at node V is voltage-current converted by the TFT122, and current i to be determined by the voltage at node v can be caused to flow into the organic light emitting element 124. Since the organic light emitting element 124 emits light with light emitting intensity proportionate to the current i, voltage to be supplied to the signal line 102 is sampled to each pixel circuit 105, whereby the intensity of the organic light emitting element 124 of each pixel circuit 105 can be controlled to display the image.

The switch matrix 111, 112 can be constituted by replacing all the TFTs of the circuit shown in FIG. 2 with p-channel TFTs. The driving waveform in that case is similar to that of FIG. 3, but positive and negative are reversed in polarity of the signal voltage.

Further, the decoder 115, 116 can be constituted by replacing all the TFTs of the circuit shown in FIG. 6 with p-channel TFTs. The driving waveform in that case is similar to that of FIG. 7, but positive and negative are reversed in polarity of the signal voltage.

Further, the shift register 113, 114 and the scanning circuit 107 can be constituted by replacing all the TFTs of the circuit shown in FIG. 8 with p-channel TFTs. The driving waveform in that case is similar to that of FIG. 9, but positive and negative are reversed in polarity of the signal voltage.

The gradation voltage source 117, 118 has the same structure as the circuit shown in FIG. 10. When all voltage of 64 types: V0 to V63 is supplied from the outside, there is no need for the gradation voltage source 117, 118.

From the foregoing, in the image display shown in FIG. 11, the TFTs for constituting the scanning circuit 107 which is each driving circuit, the switch matrix 111, 112, the shift register 113, 114 and the decoder 115, 116 together with the pixels TFT104 of the display area 106 and the pixel circuit 105 can be all constituted by p-channel TFTs.

While in the foregoing, the description has been made of the preferred embodiments of the present invention, it goes without saying that the present invention is not restricted to the above-described embodiments, but various design modifications can be made therein without departing from the spirit and scope of the present invention.

As will be apparent from the above-described embodiments, since the image display according to the present invention is capable of integrally forming the driving circuit together with the pixel transistor on a substrate, it is possible to reduce the cost.

Also, since the image display according to the present invention is capable of being constituted by only channel type transistor of either n-channel or p-channel, it is possible to reduce the cost.

Further, since the image display according to the present invention is capable of performing poly-gradation display, it is possible to express an image having a smooth change in brightness and color more accurately.

What is claimed is:

1. An image display, comprising: an image display unit constituted by a plurality of pixels; a plurality of signal lines arranged within said image display unit in order to input a display signal to said pixel; a gradation voltage line group to which gradation voltage that is an analog value is applied; switching means provided for each of said signal lines in order to selectively connect any of gradation voltage lines to which predetermined gradation voltage is applied from said gradation voltage line group to said signal line; a switch driving line for driving said switching means; decoding means for driving said switch driving line based on display signal data inputted in digital form; and switching means selecting means for selectively inputting a driving signal inputted to said switch driving line to a plurality of said switching means, wherein said pixel, said signal line, said switching means, said decoding means, and said switching means selecting means are formed on the same substrate, and wherein said pixel, said switching means, said decoding means and said switching means selecting means are constituted by only a single channel transistor of either n-channel or p-channel.

2. The image display according to claim 1, wherein said decoding means is driven through the use of a four-phase clock.

3. The image display according to claim 1, wherein for a transistor of a circuit to be formed on said substrate, there is used a polycrystal thin film transistor.

4. The image display according to claim 1, wherein said switching means selecting means is formed through the use of a shift register circuit.

5. The image display according to claim 1, wherein a trigger line for transmitting a selection signal from said switching means selecting means to said switching means and output wiring for transmitting output voltage of said switching means to said signal line are formed to intersect said gradation voltage line group.

6. An image display, comprising: an image display unit constituted by a plurality of pixels; a plurality of signal lines arranged within said image display unit in order to input a display signal to said pixel; a gradation voltage line group to which gradation voltage that is an analog value is applied; switching means provided for each of said signal lines in order to selectively connect any of gradation voltage lines to which predetermined gradation voltage is applied from said gradation voltage line group to said signal line; a switch driving line for driving said switching means; decoding means for driving said switch driving line based on display signal data inputted in digital form; and switching means selecting means for selectively inputting a driving signal inputted to said switch driving line to a plurality of said switching means, wherein said pixel, said signal line, said switching means, said decoding means, and said switching means selecting means are formed on the same substrate, wherein said pixel, said switching means, said decoding means and said switching means selecting means are constituted by only a single channel transistor of either n-channel or p-channel; and wherein said switching means is composed of: at least one first thin film transistor for connecting between said signal line and said gradation voltage line; and at least one second thin film transistor for selecting said switch through a selection signal of said switching means selecting means.

7. The image display according to claim 6, comprising at least one capacitor for retaining voltage of said switch driving line.

8. An image display, comprising: an image display unit constituted by a plurality of pixels; a plurality of signal lines arranged within said image display unit in order to input a display signal to said pixel; a gradation voltage line group to which gradation voltage that is an analog value is applied; switching means provided for each of said signal lines in order to selectively connect any of gradation voltage lines to which predetermined gradation voltage is applied from said gradation voltage line group to said signal line; a switch driving line for driving said switching means; decoding means for driving said switch driving line based on display signal data inputted in digital form; and switching means selecting means for selectively inputting a driving signal inputted to said switch driving line to a plurality of said switching means, wherein said pixel, said signal line, said switching means, said decoding means, and said switching means selecting means are formed on the same substrate; wherein said pixel, said switching means, said decoding means and said switching means selecting means are constituted by only a single channel transistor of either n-channel or p-channel; and wherein said switching means is arranged at each intersection of said switch driving line and said trigger line; said first thin film transistor connects any of said gradation voltage line groups to any of output wiring; and said second thin film transistor is connected to any of said trigger lines and any of said switch driving lines.

9. The image display according to claim 1, wherein at an output portion of a circuit constituting said decoding means, there is provided a boot-strap-circuit.

10. The image display according to claim 1, wherein said decoding means is arranged in the peripheral portion of said switching means; said switching means selecting means is arranged in the peripheral portion of said image display unit; and said decoding means is arranged on a side different from said switching means and said switching means selecting means.

11. The image display according to claim 1, wherein said image display unit is a liquid crystal display, and said transistors are all n-channel thin film transistors.

12. The image display according to claim 1, wherein said image display unit is a light emitting diode display, and said transistors are all p-channel thin film transistors.

* * * * *